US008210397B2

(12) United States Patent
Joung

(10) Patent No.: US 8,210,397 B2
(45) Date of Patent: Jul. 3, 2012

(54) DISPENSING DEVICE HAVING MIXING FUNCTION

(75) Inventor: Il Kweon Joung, Gyeonggi-do (KR)

(73) Assignee: Samsung LED Co., Ltd., Suwon (KR)

( * ) Notice: Subject to any disclaimer, the term of this patent is extended or adjusted under 35 U.S.C. 154(b) by 631 days.

(21) Appl. No.: 12/076,547

(22) Filed: Mar. 19, 2008

(65) Prior Publication Data

US 2009/0152299 A1 Jun. 18, 2009

(30) Foreign Application Priority Data

Dec. 17, 2007 (KR) ..... 10-2007-0132626

(51) Int. Cl.
*B67D 5/60* (2006.01)

(52) U.S. Cl. ..... 222/145.6; 222/145.5

(58) Field of Classification Search ..... 222/145.6, 222/145.5

See application file for complete search history.

(56) References Cited

U.S. PATENT DOCUMENTS

| | | | | |
|---|---|---|---|---|
| 4,869,400 | A * | 9/1989 | Jacobs | 222/137 |
| 5,979,794 | A * | 11/1999 | DeFillipi et al. | 239/135 |
| 6,161,730 | A * | 12/2000 | Heusser et al. | 222/137 |
| 6,691,932 | B1 * | 2/2004 | Schultz et al. | 239/401 |
| 6,955,277 | B2 | 10/2005 | Smith et al. | |
| 7,387,432 | B2 * | 6/2008 | Lu et al. | 366/339 |
| 7,575,131 | B2 * | 8/2009 | Feinberg et al. | 222/137 |
| 7,690,539 | B1 * | 4/2010 | Tudor et al. | 222/459 |
| 7,748,567 | B2 * | 7/2010 | Horner et al. | 222/135 |
| 7,775,399 | B2 * | 8/2010 | Wood | 222/94 |
| 7,806,297 | B2 * | 10/2010 | Pauser et al. | 222/129 |
| 2005/0043546 | A1 | 2/2005 | Brechtelsbauer et al. | |
| 2005/0161477 | A1 * | 7/2005 | Strecker et al. | 222/504 |
| 2007/0175921 | A1 * | 8/2007 | Keller | 222/137 |
| 2007/0187434 | A1 * | 8/2007 | Schrafel | 222/459 |
| 2008/0227052 | A1 | 9/2008 | Peuker et al. | |
| 2008/0267005 | A1 * | 10/2008 | Reinprecht | 366/162.3 |
| 2008/0314929 | A1 * | 12/2008 | Keller | 222/145.6 |
| 2010/0252574 | A1 * | 10/2010 | Busin | 222/137 |

FOREIGN PATENT DOCUMENTS

| | | | |
|---|---|---|---|
| JP | 55-107273 | | 7/1980 |
| JP | 62-43626 | | 3/1987 |
| JP | 63-57773 | | 4/1988 |
| JP | 2-91677 | | 7/1990 |
| JP | 5-31427 | | 2/1993 |
| JP | 05-031427 | * | 2/1993 |
| JP | 8-187727 | | 7/1996 |
| JP | 2004-98608 | | 4/2004 |

(Continued)

OTHER PUBLICATIONS

Korean Notice of Allowance issued on Apr. 9, 2009 in corresponding Korean Patent Application 10-2007-0132626.

(Continued)

*Primary Examiner* — Kevin P Shaver
*Assistant Examiner* — Donnell Long

(57) ABSTRACT

Provided is a dispensing device including a cylinder; a static mixer that is mounted in the cylinder such that the outer circumferential surface thereof is closely attached to the entire inner wall surface of the cylinder; and a flow path block that has a flow path formed therein and is mounted on the upper portion of the cylinder, the flow path diverging into two or more flow paths. Fluids passing through the static mixer are continuously transferred while being repeatedly divided and mixed.

2 Claims, 7 Drawing Sheets

FOREIGN PATENT DOCUMENTS

| | | |
|---|---|---|
| JP | 2004-202289 | 7/2004 |
| JP | 2005-500350 | 1/2005 |
| JP | 2006-68698 | 3/2006 |
| JP | 2006-123399 | 5/2006 |
| JP | 2006-136935 | 6/2006 |
| JP | 2007-38060 | 2/2007 |
| JP | 2007-523710 | 8/2007 |
| KR | 20-0313017 | 4/2003 |

OTHER PUBLICATIONS

Japanese Office Action issued Apr. 26, 2011 in corresponding Japanese Patent Application 2008-062540.

Japanese Office Action dated Mar. 6, 2012 issued in corresponding Japanese Patent Application No. 2008-062540.

* cited by examiner

[FIG. 1]
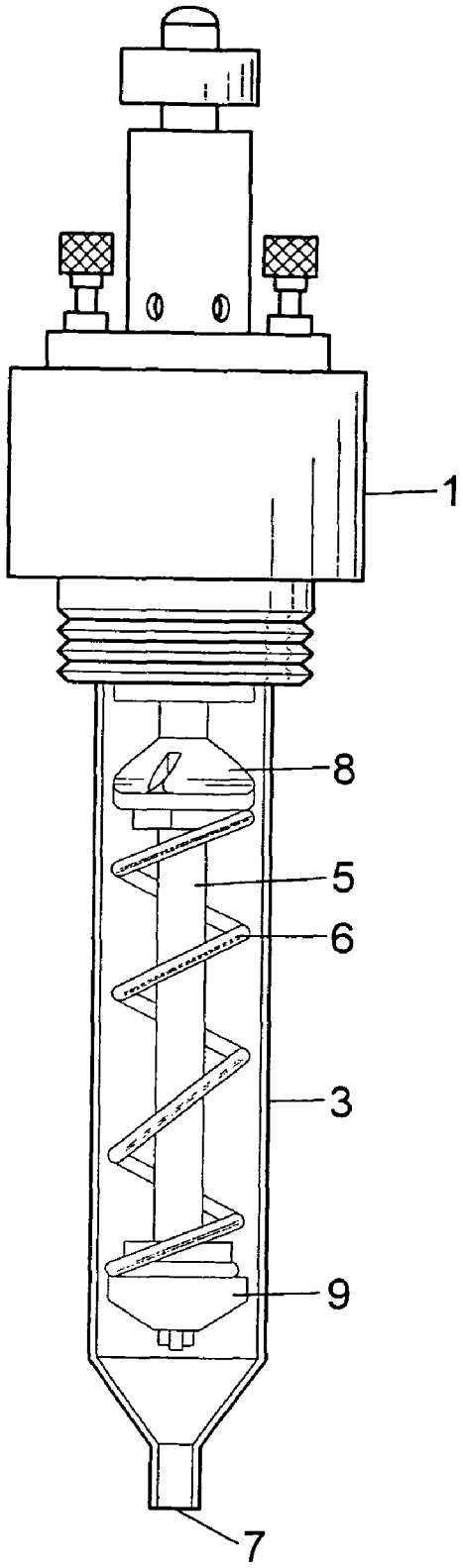

[FIG. 2]
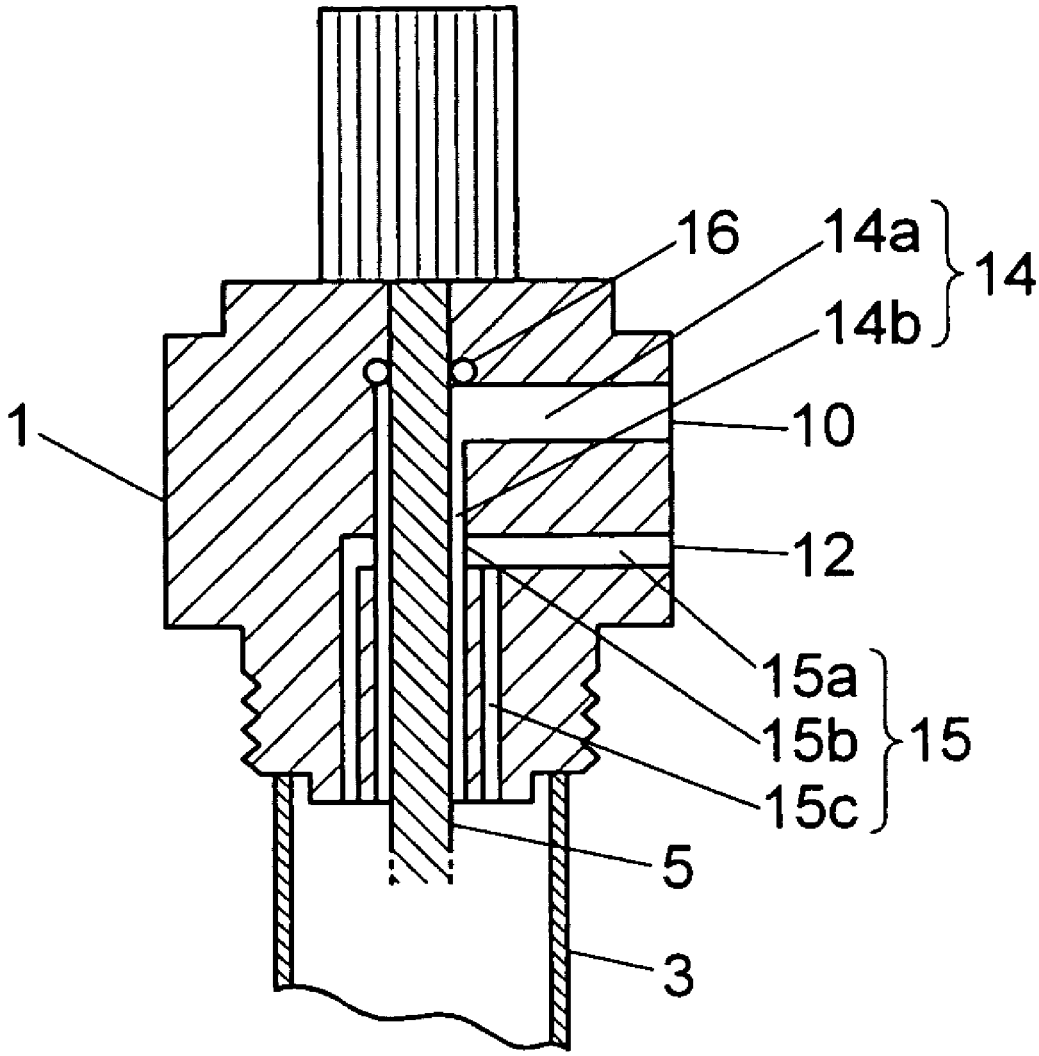

[FIG. 3]
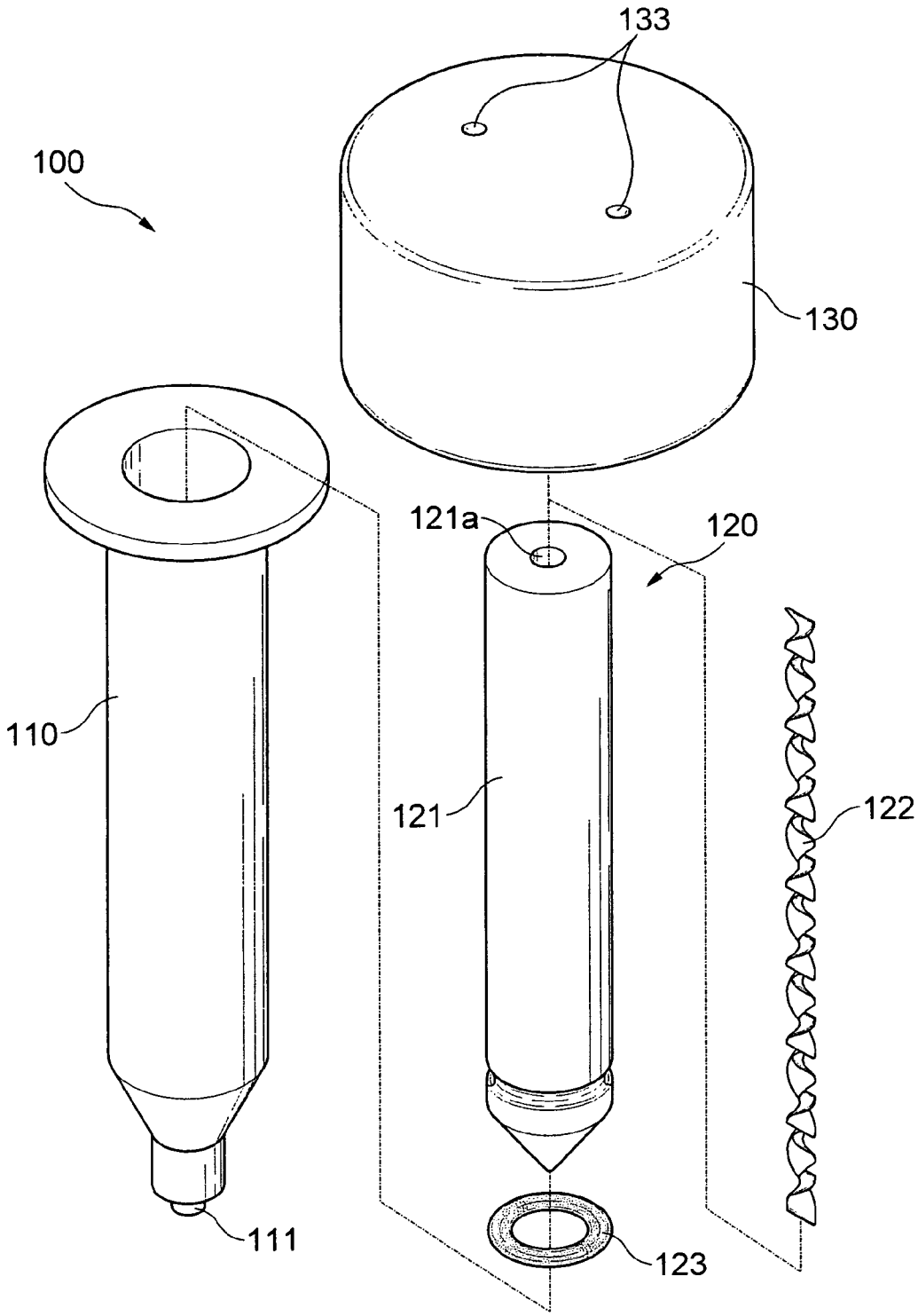

[FIG. 4]
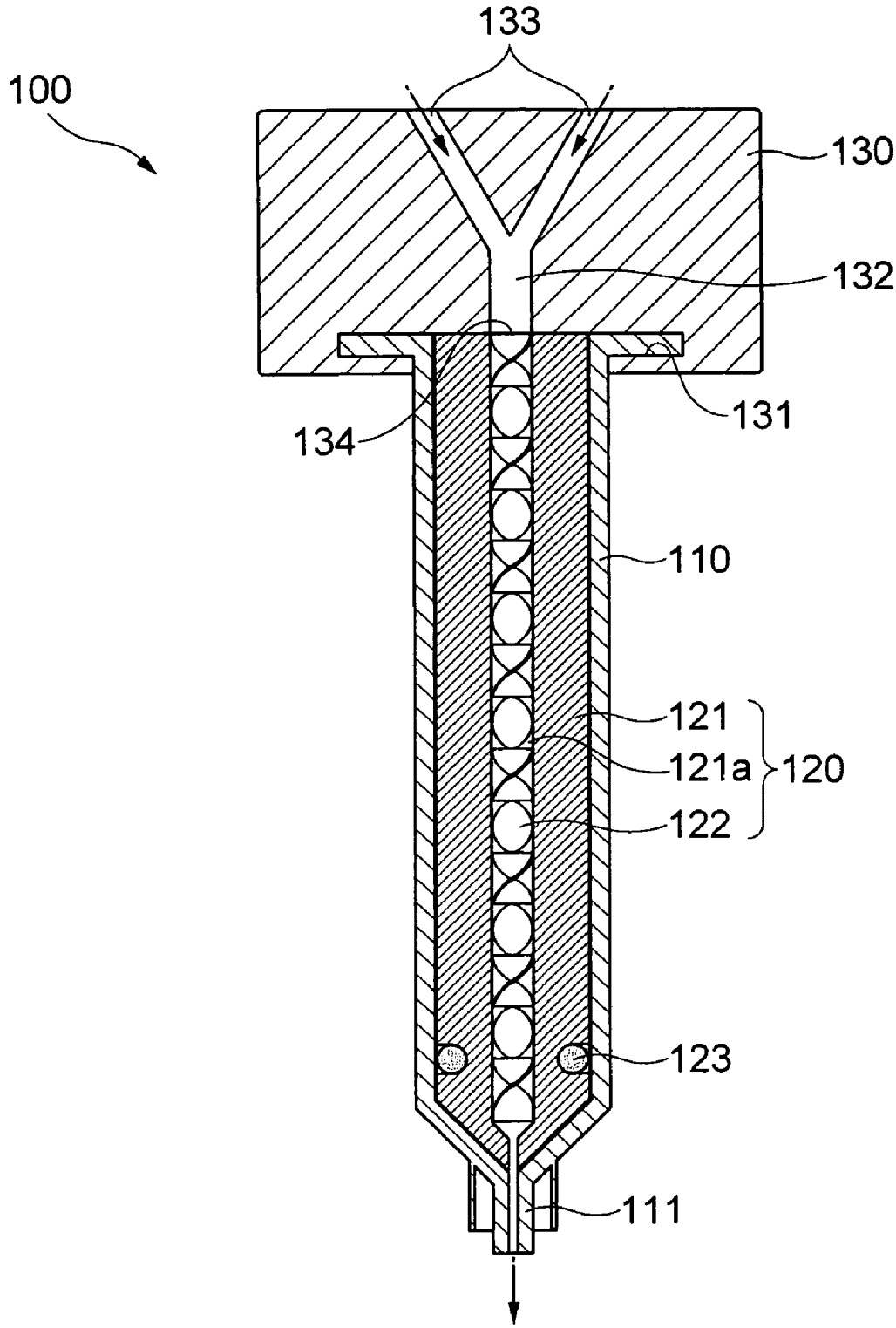

[FIG. 5]
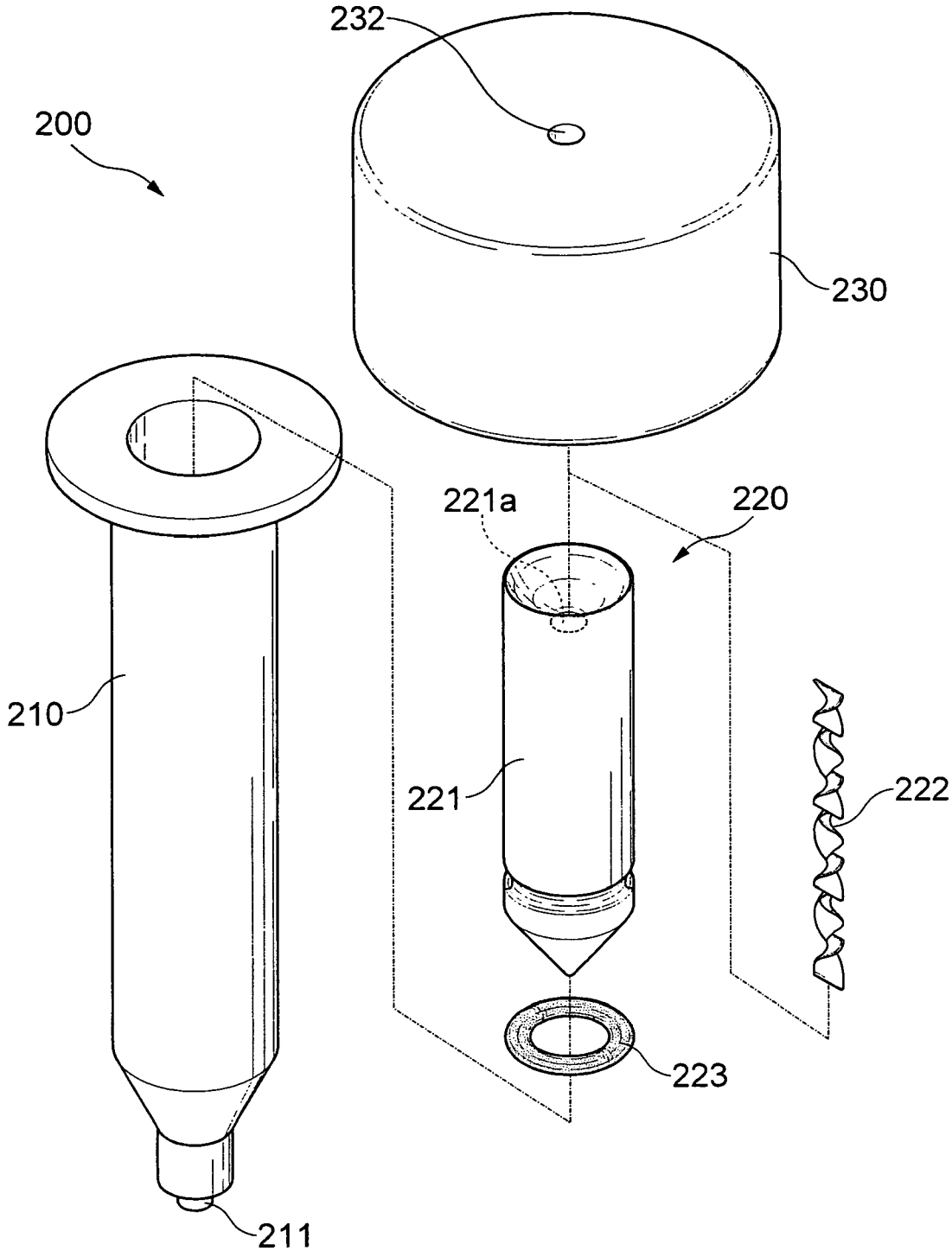

[FIG. 6]
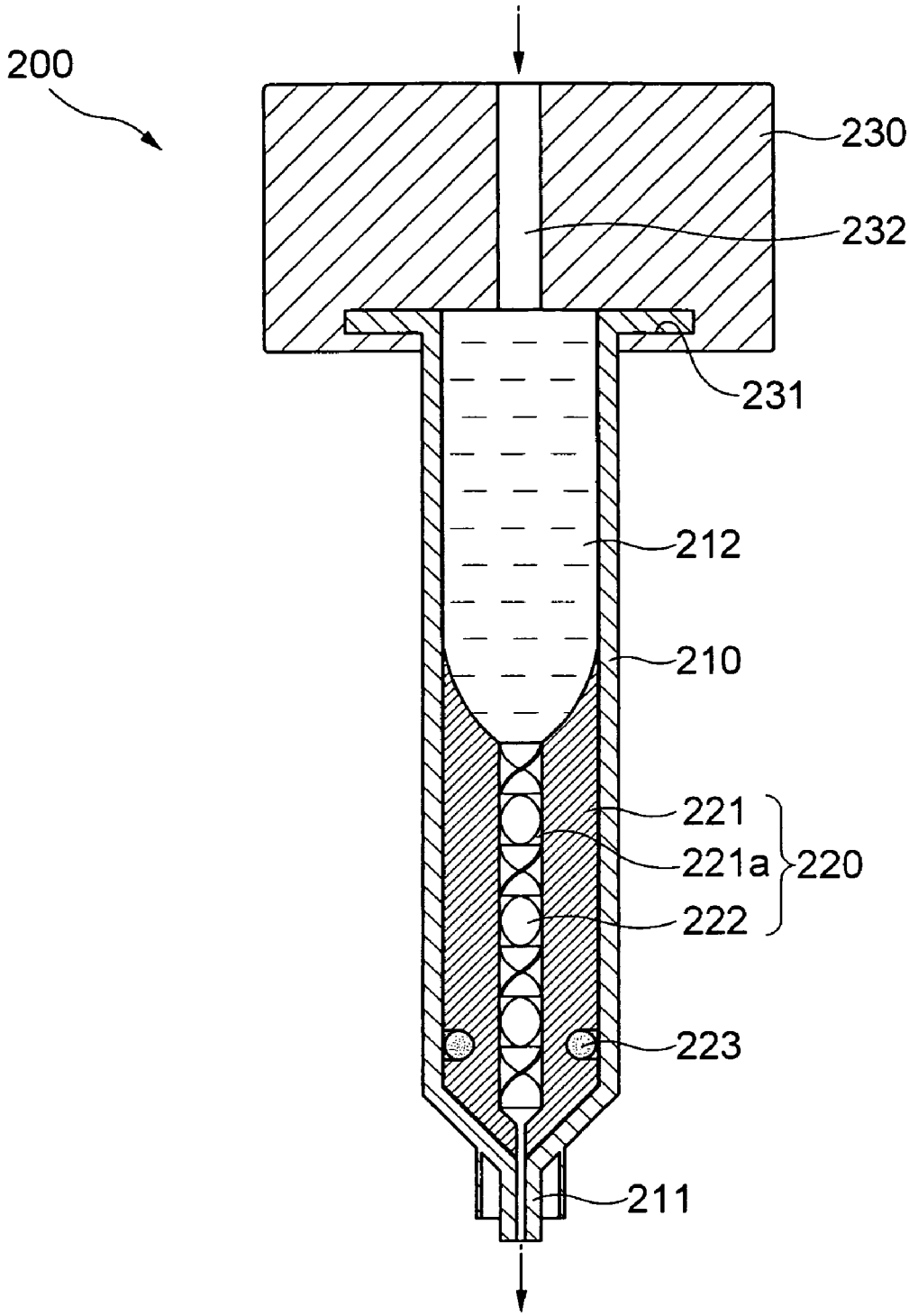

[FIG. 7]
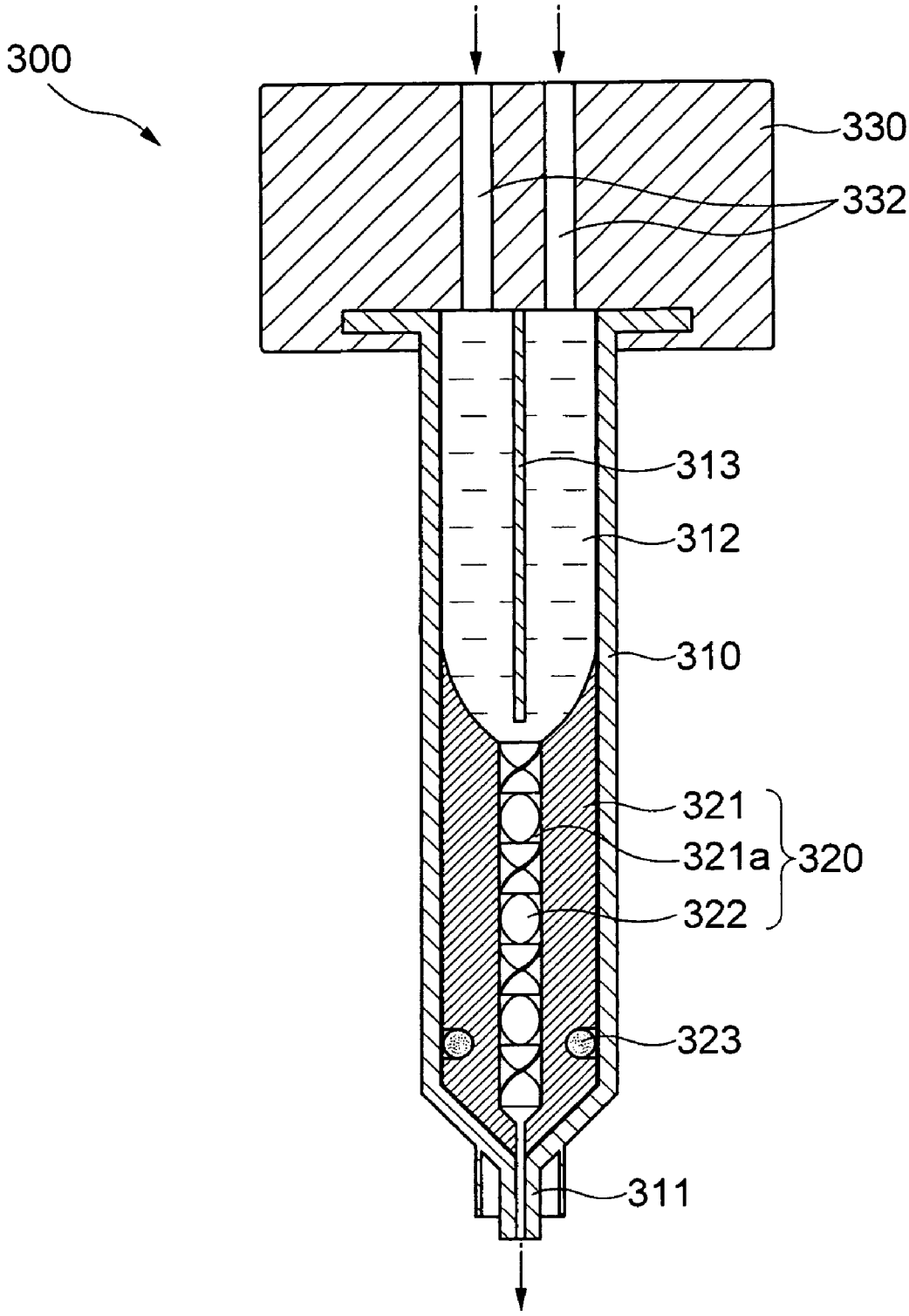

DISPENSING DEVICE HAVING MIXING FUNCTION

CROSS-REFERENCE TO RELATED APPLICATIONS

This application claims the benefit of Korean Patent Application No. 10-2007-0132626 filed with the Korea Intellectual Property Office on Dec. 17, 2007, the disclosure of which is incorporated herein by reference.

BACKGROUND OF THE INVENTION

1. Field of the Invention

The present invention relates to a dispensing device having a mixing function.

2. Description of the Related Art

In general, a dispensing device for dispensing a predetermined liquid material is used to form a molding compound to protect the outside of a light emitting diode (LED) or to coat liquid resin, by a predetermined amount, on the surface of an electronic part.

A conventional dispensing device dispenses a liquid mixture in which two or more liquid materials are mixed. In the conventional dispensing device, two or more liquid materials cannot be mixed therein, because a separate mixing means is not provided. Therefore, two or more liquid materials are uniformly mixed by a separate mixer. The liquid mixture is injected into the dispensing device such as a dispenser or syringe and is then dispensed by a predetermined pressure.

In such a conventional dispensing device, however, the mixing process should be performed before two or more liquid materials are injected into the dispensing device. Therefore, it takes time to mix the materials. Further, it takes time to inject the liquid materials to the dispensing device.

To solve such a problem, a dispensing device has been developed (refer to Japanese Unexamined Patent Application Publication No 2004-202289), which simultaneously mixes and dispenses liquid materials after the liquid materials are injected. In such a dispensing device, the mixing is performed by a rotating body driven in a cylinder.

FIG. 1 is a side view of a conventional dispensing device, and FIG. 2 is an expanded cross-sectional view of a liquid injection portion of the conventional dispensing device.

As shown in FIGS. 1 and 2, the conventional dispensing device includes a mixing spring 6, which is mounted in a syringe 3 and is connected to a rotor 8, and a flow path block 1 having flow paths 14 and 15 coupled to the upper portion of the syringe 3. Two or more kinds of liquids are injected into the flow paths 14 and 15.

The mixing spring 6 built in the syringe 3 is rotated by a motor so as to mix the liquids injected into the syringe 3.

Further, the flow path block 1 communicates with the inside of the syringe 3 and has a plurality of flow paths which are vertically and horizontally connected to a first liquid supply portion 10 and a second liquid supply portion 20. The inside of the first liquid supply portion 10 is sealed by a seal member 16 so as to prevent the injected liquid from leaking around a shaft 5.

In the conventional dispensing device constructed in such a manner, the mixing spring 6 is forcibly rotated inside the syringe 3 by the rotor 8 to mix the liquids around the mixing spring 6. However, since the mixing spring 6 should be rotated to mix the liquids in the syringe 3, a predetermined mixing time is still required.

Further, to drive the mixing spring 6 mounted in the syringe 3, the rotor 8 or a motor connected to the rotor 8 should be provided. Furthermore, since a controller for controlling the driving motor is needed, the size of the dispensing device inevitably increases, and the structure thereof becomes complex.

As the conventional dispensing device has a complex structure, a manufacturing cost increases. Further, since the rotor or the motor and the controller are necessary, an extra cost inevitably occurs.

SUMMARY OF THE INVENTION

An advantage of the present invention is that it provides a dispensing device with a mixing function, which has a structure that a flow path block having a flow path formed therein is coupled to the upper portion of a cylinder having a static mixer built therein. In the dispensing device, two kinds of liquid materials injected through the flow path block are mixed while being transferred through the static mixer inside the cylinder, and the liquid mixture is dispensed through a dispensing port.

Additional aspects and advantages of the present general inventive concept will be set forth in part in the description which follows and, in part, will be obvious from the description, or may be learned by practice of the general inventive concept.

According to an aspect of the invention, a dispensing device comprises a cylinder; a static mixer that is mounted in the cylinder such that the outer circumferential surface thereof is closely attached to the entire inner wall surface of the cylinder; and a flow path block that has a flow path formed therein and is mounted on the upper portion of the cylinder, the flow path diverging into two or more flow paths. Fluids passing through the static mixer are continuously transferred while being repeatedly divided and mixed.

Preferably, the upper portion of the cylinder is opened, and the cylinder has a dispensing port which is formed at the lower end thereof and through which the fluid is discharged.

Preferably, the static mixer includes a mixer body of which the outer circumferential surface is closely coupled to the inner circumferential surface of the cylinder in the longitudinal direction thereof, the mixer body having a fluid transfer passage formed in the central portion thereof; and a plurality of elements coupled into the fluid transfer passage.

Preferably, the mixer body has a sealing member mounted on the lower portion thereof, the sealing member being closely attached to the inner wall surface of the cylinder.

As the respective elements twisted at 180 degrees are consecutively connected to each other such that one element crosses the next element at 90 degrees, the fluids passing through the respective elements are repeatedly divided and mixed in accordance with the number of the elements.

According to another aspect of the invention, a dispensing device comprises a cylinder; a static mixer that is mounted in the cylinder such that the outer circumferential surface thereof is closely attached to the inner wall surface of the lower portion of the cylinder; a chamber formed over the static mixer inside the cylinder; and a flow path block that has a flow path formed in the central portion thereof and is mounted in the upper portion of the cylinder. Fluids passing through the static mixer are continuously transferred while being repeatedly divided and mixed.

Preferably, the upper portion of the cylinder is opened, and the cylinder has a dispensing port which is formed at the lower end thereof and through which the fluid is discharged.

Preferably, the static mixer includes a mixer body of which the outer circumferential surface is closely coupled to the inner circumferential surface of the lower portion of the cylinder, the mixer body having a fluid transfer passage formed in the central portion thereof; and a plurality of elements coupled into the fluid transfer passage.

Preferably, the mixer body has a sealing member mounted on the lower portion thereof, the sealing member being closely attached to the inner wall surface of the cylinder.

According to a further aspect of the invention, a dispensing device comprises a cylinder; a static mixer that is mounted in the cylinder such that the outer circumferential surface thereof is closely attached to the inner wall surface of the lower portion of the cylinder; a chamber formed over the static mixer inside the cylinder and having a partition wall which partitions the internal space of the chamber into two parts and of which the lower end is spaced at a predetermined distance from the static mixer; and a flow path block that has a pair of flow paths formed in parallel to each other such that the partitioned spaces of the chamber can be connected to the respective flow paths, the flow path block being mounted on the upper portion of the cylinder. Fluids passing through the static mixer are continuously transferred while being repeatedly divided and mixed.

Preferably, the upper portion of the cylinder is opened, and the cylinder has a dispensing port which is formed at the lower end thereof and through which the fluid is discharged.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a side view of a conventional dispensing device;

FIG. 2 is an expanded cross-sectional view of a liquid injection portion of the conventional dispensing device;

FIG. 3 is an exploded perspective view of a dispensing device according to a first embodiment of the invention;

FIG. 4 is a cross-sectional view of the dispensing device according to the first embodiment of the invention;

FIG. 5 is an exploded perspective view of a dispensing device according to a second embodiment of the invention;

FIG. 6 is a cross-sectional view of the dispensing device according to the second embodiment of the invention; and FIG. 7 is a cross-sectional view of a dispensing device according to a third embodiment of the invention.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Hereinafter, a dispensing device having a mixing function according to an embodiment of the present invention will be described in detail with reference to the accompanying drawings.

FIG. 3 is an exploded perspective view of a dispensing device according to a first embodiment of the invention, and FIG. 4 is a cross-sectional view of the dispensing device according to the first embodiment of the invention.

As shown in FIGS. 3 and 4, the dispensing device 100 according to this embodiment includes a cylinder 110 having a static mixer 120 mounted therein and a flow-path block 130 coupled to the upper portion of the cylinder 110.

The cylinder 110 is formed in a typical syringe shape of which the upper portion is opened and has a dispensing port 111 for dispensing liquid contained in the cylinder 110, the dispensing port 111 being formed at the lower end of the cylinder 110.

In the static mixer 120 built in the cylinder 110, liquid materials, that is, fluids injected from above are transferred and mixed. The static mixer 120 includes a mixer body 121, which is closely coupled to the entire inner wall surface of the cylinder 110, and a plurality of elements 122 coupled into the mixer body 121.

The static mixer 120 has a fluid transfer passage 121*a* formed in the central portion of the mixer body 121. The plurality of elements 122 are mounted into the fluid transfer passage 121*a* so as to divide and mix fluids transferred through the fluid transfer passage 121*a*.

The elements 122 mounted in the static mixer 120 are connected in parallel to each other. Each of the elements 122 is formed in such a shape that a flow path is twisted at 180 degrees. When the plurality of elements 122 are continuously disposed in parallel to each other, one element 122 crosses the next element 122 at 90 degrees.

Therefore, fluids are divided while passing through one element 122. Then, the divided fluids are mixed while passing through the next element 122 which is disposed to cross the previous element 122. Accordingly, as the dividing and mixing of the fluids is repeated, the fluids are uniformly mixed while being transferred.

Further, since the mixer body 121 mounted in the cylinder 110 has an O-ring-shaped sealing member 123 mounted in the lower portion thereof, the mixer body 121 is closely coupled to the inner wall surface of the cylinder 110.

Meanwhile, the flow-path block 130 for injecting liquid materials into the static mixer 120 mounted in the cylinder 110 is mounted on the upper portion of the cylinder 110.

The flow path block 130 has a cylinder fixing groove 131 formed in the lower portion thereof and a flow path 132 passing through the inside thereof.

In this case, the flow path block 130 has two or more injection holes 133 formed on the upper surface thereof, the injection holes 133 being connected to two or more flow paths which diverge from the flow path 132. Further, the flow path block 130 has one discharge hole 134 provided at the lower end of the flow path 132.

The flow path block 130 is closely coupled to the upper portion of the cylinder 110 such that the lower discharge hole 134 of the flow path 132 provided in the flow path block 130 corresponds to the upper end of the fluid transfer passage 121*a* of the mixer body 121 mounted on the cylinder 110.

In the dispensing device 100 constructed in such a manner, a predetermined pressure is applied to simultaneously inject different liquid materials into the cylinder 110 through the injection holes 133 formed on the top surface of the flow path block 30 in a state where the cylinder 110 and the flow path block 30 are closely coupled to each other.

The liquid materials injected through the injection holes 133 join in the flow path block 130 through one flow path and are then transferred to the fluid transfer passage 121*a* of the static mixer 120 mounted in the cylinder 110.

The liquid materials introduced into the fluid transfer passage 121*a* are repeatedly divided and mixed while being transferred to the lower portion of the fluid transfer passage 121*a* through the plurality of elements 122 as described above. Then, the liquid materials are uniformly mixed in the fluid transfer passage 121*a* and are then discharged to the outside through the lower dispensing port 111 of the cylinder 110.

In the dispensing device 100 according to this embodiment, liquid materials are mixed while passing through the plurality of elements 122 in the fluid transfer passage 121*a* formed along the overall length of the cylinder 110, without a separate driving device for mixing liquid materials. While being transferred along the cylinder 110 having a relatively large length, the liquid materials are completely mixed. Then, the mixed liquid is discharged through the dispensing port 111.

FIG. 5 is an exploded perspective view of a dispensing device according to a second embodiment of the invention, and FIG. 6 is a cross-sectional view of the dispensing device according to the second embodiment of the invention.

In this embodiment, the descriptions of the same components as those of the dispensing device according to the first embodiment of the invention will be omitted to avoid the duplicated descriptions.

As shown in FIG. 5, the dispensing device 200 includes a cylinder 210, which has a static mixer 220 mounted in such a manner that a chamber 212 is formed in the cylinder 210, and a flow path block 230 coupled to the upper portion of the cylinder 210.

More specifically, the static mixer 220 is mounted in the lower portion of the cylinder 210, and the chamber 212 for storing a liquid material is formed in the upper portion of the cylinder 210.

The static mixer 220 has the same construction as the static mixer 120 mounted in the dispensing device according to the first embodiment of the invention. That is, the static mixer 220 has a plurality of elements 222 inserted into a fluid transfer passage 221*a* formed in the central portion of a mixer body 221.

Further, the mixer body 221 is closely coupled to the inner wall surface of the cylinder 210 and has an O-ring-shaped sealing member 223 mounted in the lower portion thereof such that the liquid material within the chamber 212 is not introduced between the mixer body 221 and the inner surface of the cylinder 210.

Meanwhile, the flow path block 230 having a cylinder fixing groove 231 formed in the lower portion thereof is mounted on the upper portion of the cylinder 210. The upper portion of the cylinder 210 is inserted into the cylinder fixing groove 231 such that the flow path block 230 and the cylinder 210 are coupled to each other. Further, the flow path block 230 has a flow path 232 passing through the upper and lower portions thereof.

The flow path 232 formed in the flow path block 230 is connected to the chamber 212 formed in the cylinder 210, and a liquid material injected through the flow path 232 is introduced into the chamber 212 of the cylinder 210. The introduced liquid material is stored in the chamber 212 until it is mixed.

In the dispensing device 200 constructed in such a manner, liquid materials having a different property are sequentially injected through the flow path 232 passing through the flow path block 230 in a state where the cylinder 210 and the flow path block 230 are closely coupled to each other.

The liquid materials which have been sequentially injected through the flow path 232 are temporarily stored in the chamber 212 of the cylinder 210 and are primarily mixed due to a difference in specific gravity.

The liquid materials which have been primarily mixed in the chamber 212 are introduced into the fluid transfer passage 221*a* of the static mixer 220 mounted in the lower portion of the cylinder 210. As the liquid materials are repeatedly divided and mixed while passing through the plurality of elements 222 inserted into the fluid transfer passage 221*a*, they are mixed. A liquid mixture resulting from the mixing is discharged to the outside of the cylinder 210 through the dispensing port 211 of the cylinder 210.

The different liquid materials which are sequentially injected into the chamber 212 through the flow path 232 of the flow path block 230 should be primarily mixed in the chamber 212 so as to be introduced into the fluid transfer passage 221*a* at a substantially-uniform proportion. Therefore, the dispensing device according to this embodiment is effectively used to mix and dispense more than two liquid materials, which are injected into the chamber 212 and between which a difference in specific gravity is not large.

FIG. 7 is a cross-sectional view of a dispensing device according to a third embodiment of the invention. As shown in FIG. 7, the dispensing device 300 has a structure that a partition wall 313 is formed in a chamber 312 formed in a cylinder 310 having a static mixer 320 mounted therein. The partition wall 313 partitions an internal space of the chamber 312 into two parts.

The upper portion of the cylinder 310 is coupled to a flow path block 330 having a pair of flow paths 332 such that different kinds of liquid materials can be injected into the chamber 312 partitioned by the partition wall 313.

That is, when different kinds of liquid materials are injected through the pair of flow paths 332 passing through the flow path block 330 in a state where the flow path block 330 is coupled to the upper portion of the cylinder 310, the respective liquid materials are individually injected into the chamber 312 connected to the flow paths 332.

The liquid materials introduced through the pair of flow paths 332 are stored in the chamber 312 in a state where they are separated from each other by the partition wall 313. The liquid materials are introduced, by a predetermined amount, through a space under the partition wall 313 into the fluid transfer passage 312*a* provided in the static mixer 320.

The different kinds of liquid materials introduced into the fluid transfer passage 321*a* are mixed while passing through a plurality of elements 322 mounted in the fluid transfer passage 321*a*, like the first and second embodiments. Then, the mixed liquid materials are discharged to the outside through a dispensing port 311 formed at the lower end of the cylinder 310.

The dispensing device according to this embodiment is effectively used to mix and dispense liquid materials which are vertically split from each other when they are introduced into the chamber 312, because of a large difference in specific gravity.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A dispensing device comprising:

a cylinder;

a static mixer having a mixer body of which an outer circumferential surface is closely coupled to an entire inner circumferential wall surface of the cylinder in a longitudinal direction thereof, the mixer body having a fluid transfer passage formed in a central portion thereof and a plurality of elements coupled into the fluid transfer passage;

a flow path block having a flow path formed therein and mounted on an upper portion of the cylinder, the flow path having a discharge hole provided at a lower end thereof and two or more sub-flow paths at an upper end thereof, each sub-flow path having an injection hole provided at an upper end thereof, fluids passing through the static mixer being continuously transferred while being repeatedly divided and mixed, the elements being twisted at 180 degrees and consecutively connected to each other such that one of the elements crosses a following elements at 90 degrees so that the fluids passing through the elements are repeatedly divided and mixed in accordance with a number of the elements, the mixer body has a sealing member mounted on a lower portion thereof, and the sealing member is formed along a portion of an outer circumferential surface of the mixer body and closely attached to the inner wall surface of the cylinder.

2. The dispensing device according to claim 1, wherein the upper portion of the cylinder is opened, and the cylinder has a dispensing port which is formed at a lower end thereof and through which the fluids are discharged.

* * * * *

UNITED STATES PATENT AND TRADEMARK OFFICE

CERTIFICATE OF CORRECTION

PATENT NO. : 8,210,397 B2
APPLICATION NO. : 12/076547
DATED : July 3, 2012
INVENTOR(S) : Il Kweon Joung It is certified that error appears in the above-identified patent and that said Letters Patent is hereby corrected as shown below:

In the Claims

Column 7, Line 7, In Claim 1, delete "elements at" and insert -- element at --, therefor.

Signed and Sealed this
Twenty-fifth Day of June, 2013

Teresa Stanek Rea
*Acting Director of the United States Patent and Trademark Office*